United States Patent [19]

Kärnä et al.

[11] Patent Number: 4,964,364

[45] Date of Patent: Oct. 23, 1990

[54] APPARATUS FOR COATING A WEB WITH COATING MIX

[75] Inventors: Anssi Kärnä, Inkeroinen; Jukka Heikkinen, Kerava; Juhani Eskelinen, Helsinki, all of Finland

[73] Assignee: Valmet Paper Machinery Inc., Helsinki, Finland

[21] Appl. No.: 302,453

[22] Filed: Jan. 27, 1989

[30] Foreign Application Priority Data

Jan. 29, 1988 [FI] Finland ..... 880420

[51] Int. Cl.[5] ..... B05C 3/12

[52] U.S. Cl. ..... 118/410; 118/413; 118/419

[58] Field of Search ..... 118/410, 407, 418, 419

[56] References Cited

U.S. PATENT DOCUMENTS 4,398,494 8/1983 Alheld ..... 118/410
4,534,309 8/1985 Damrau et al. ..... 118/410
4,594,963 6/1986 Krautzberger ..... 118/410
4,688,516 8/1987 Sommer ..... 118/410

*Primary Examiner*—Willard Hoag
*Attorney, Agent, or Firm*—Birch, Stewart, Kolasch & Birch

[57] ABSTRACT

This publication describes a short-dwell coater for coating a web with coating mix against a rotating backing roll. The coater comprises a support structure, a feeder means adapted to the front lip for feeding the coating mix into an application zone formed between the backing roll and the support structure, and an actual doctor blade, adapted into the support structure to press against the web, with which blade the excess coating mix passing over form the application zone can be removed. According to the invention, a separate predoctoring blade is adapted at a short distance before the actual doctor blade in the machine direction of the web for smoothing out disturbances in the coating mix flow before the mix proceeds up to the actual doctor blade.

4 Claims, 2 Drawing Sheets

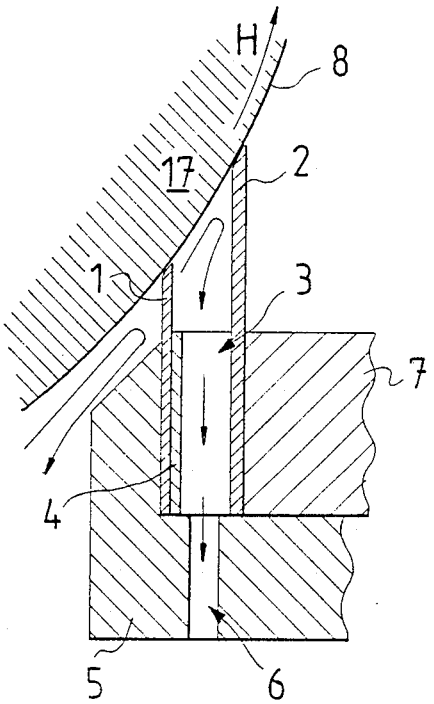
Fig.2
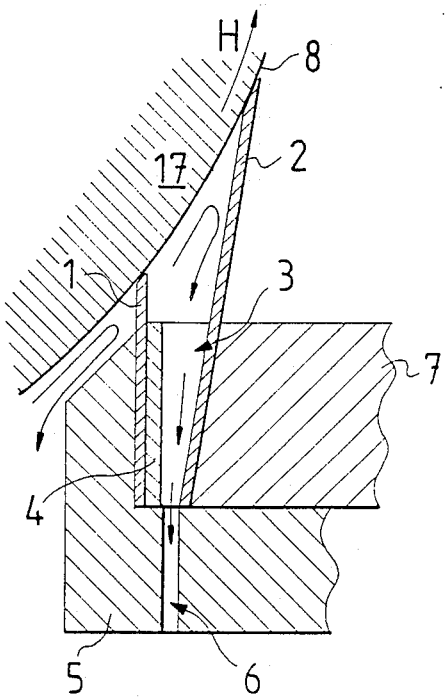
Fig.3
Fig. 4(A)
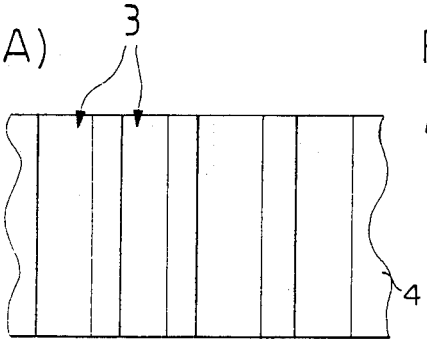
Fig. 4(B)
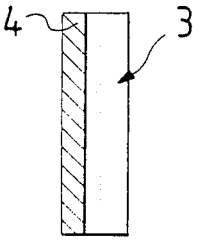
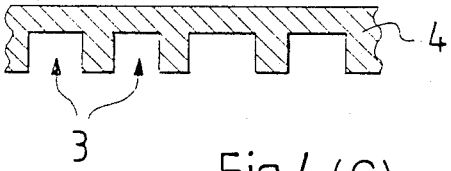
Fig.4(C)

APPARATUS FOR COATING A WEB WITH COATING MIX

BACKGROUND OF THE INVENTION

The present invention relates to a short-dwell coater.

In constructions of the prior art, the behaviour of the coating mix in the application zone is sensitive to disturbance such as an uneven spread of the applied mix. This typically results in a longitudinal stripe patterning of the applied coating on the web.

BRIEF DESCRIPTION OF THE INVENTION

The aim of this invention is to overcome the disadvantages associated with the prior art technology described above and to achieve a totally new kind of a short-dwell coater.

The invention is based on adapting within the application zone, before the actual doctor blade, a predoctoring blade, which smooths the coating mix flow. Part of the coating mix flows within the application zone through a slit formed between the front lip and the web into collecting trays thus imparting to the prevention of air entrainment into the applied mix. Another part of the coating mix is carried on the web to the predoctoring blade, which smooths an essentially homogenized coating paste layer, which is then further smoothed by the actual doctor blade. The excess coating mix is removed into the recirculation flow.

The purpose of the predoctoring blade is to provide homogenization of the coating flow mix particularly in the cross direction of the machine. Splashing may also occur in the flow, because the reflow from the predoctoring blade has an extremely high velocity and the gap between the front lip and the web does not remain filled with the mix. Part of this mix flows along with the web movement to the predoctoring blade, which is adjusted so as to pass along a sufficiently high mix flow to the actual doctor blade that ensures doctoring, flushing and the achievement of a smooth profile.

The invention provides benefits as follows:

- longitudinal stripe patterning which is characteristic to the short-dwell coating can be avoided,
- penetration of the coating mix into the web (e.g., the base paper web) is improved,
- splashing is reduced,
- coating mix feed rate can be lowered,
- coating mixes with higher solids concentration and higher viscosity can be used,
- higher coating rates and production speeds can be achieved,
- doctor blade pressure against the web is lower than in single-blade coating, whereby the loading on the web (base paper web) is lower and a cheaper web material (base paper web) can be used, and
- blade wear is retarded.

BRIEF DESCRIPTION OF THE DRAWING

The invention is next examined in greater detail with help of the exemplifying embodiments illustrated in the attached drawings.

FIG. 2 shows in a partially diagrammatic cross-sectioned side view a second embodiment of a short-dwell coater in accordance with the invention.

FIG. 3 shows in a partially diagrammatic cross-sectioned side view a third embodiment of a short-dwell coater in accordance with the invention.

FIG. 4 shows in a top view, cross-sectioned side view, and longitudinally sectioned side view an intermediary piece used in the short-dwell coater illustrated in FIG. 2 in an end view depicting the web entrance direction.

DETAILED DESCRIPTION OF THE PREFERRED EMBODIMENTS

Figure 1:
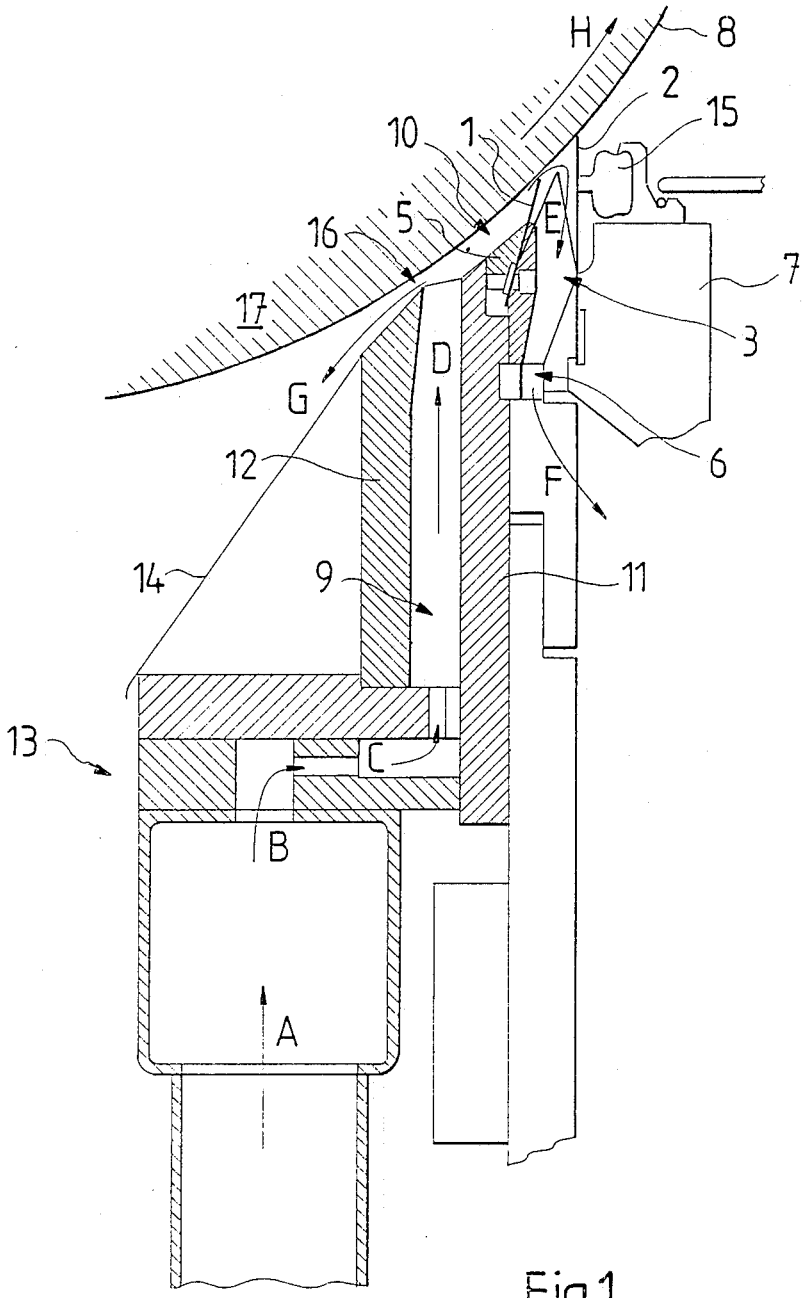
FIG. 1 shows in detail a short-dwell coater in accordance with the invention in a cross-sectioned side view.

In accordance with FIG. 1, the short-dwell coater comprises a backing roll 17 rotating in the direction indicated by arrow H and having a paper web 8 to be coated conforming to its surface. An application zone 10 is formed between a support structure 13 and a backing roll 17. The coating mix is fed through the support structure (arrows A, B, C, D) to the application zone 10. Mounted on the support structure 13 by means of a separate mounting piece 7 is an actual doctor blade 2, which is inclinable by means of a pressure tube 15 to a desired angle in respect with the web 8. At a short distance before the actual doctor blade 2 in the machine direction, there is arranged a separate predoctoring blade 1. This blade is adapted in a similar manner to press against the web 8, although at a lesser pressure than the actual doctor blade 2. This method provides for smoothing out disturbances created in the coating mix within the application zone before the mix proceeds up to the actual doctor blade 2. The distance of the predoctoring blade 1 from the actual doctor blade 2 is set so as to obtain a sweep interval of 25 . . . 150 us, preferably 50 us, for sweep of the web 8 under the two blades 1, 2.

In the illustrated embodiment, the blades 1, 2 are arranged to obtain a tapering spacing of the blades toward the tips. The coating mix is enters through a gap 9 between plates 11 and 12 (arrow D) into the application zone 10, where it is divided into one flow passing over the predoctoring blade 1 (arrow E) and a second flow passing via a throttling point 16 at the inlet side of the application zone 10 (arrow G). The throttling point effectively inhibits deleterious air from entering along with the mix via the point into the application zone 10. The excess coating mix then flows downward along the plate 14 into collecting trays (not shown).

The predoctoring blade 1 is attached by means of conventional fixture elements to the upper part of the plate 11. Excess coating mix remaining between the blades 1 and 2 has access via gaps 3 and 6 downward into the recirculation flow (arrow F).

In the embodiment illustrated in FIG. 2, the predoctoring blade 1 and the actual doctor blade 2 is attached to a clamp between parts 5 and 7 of the support structure 13 by means of an intermediary piece 4 between the blades 1 and 2. This intermediary piece 4 determines the spacing between the blades 1 and 2. It has gaps 3 for removal of excess coating mix entering between the blades 1 and 2. The detachable intermediary piece 4 has a comb-like cross section (FIG. 4), whereby the gaps 3 are formed by the spaces remaining between the fingers of the comb and the adjoining actual doctor blade 2. The intermediary piece 4 may obviously be reversed so as to place the gaps at the predoctoring blade 1 side. In the illustrated embodiment, the intermediary piece 4 has a constant thickness thus aligning the planes of the blades 1 and 2 parallel.

In the modification illustrated in FIG. 3, the intermediary piece has a wedge-shaped cross section with an increasing thickness toward the tips of the blades 1 and 2. Thence, also the spacing of the blades 1 and 2 increases toward the tips. By designing a proper taper of the intermediary piece, the angle subtended between the blades 1 and 2 can be set to a desired value.

The intermediary piece 4, which can be manufactured of, e.g., plastic or steel, is readily detachable for cleaning.

The pressurization of the intermediate space between the blades 1 and 2 is achievable by adjustable throttling at the outlet side of the coating paste flow.

What is claimed is:

1. A short-dwell coater for coating a web with a coating mix against a rotating backing roll, comprising a support structure, a feeder means adapted to the support structure for feeding coating mix into an application zone formed between the backing roll and the support structure, an actual doctor blade, adapted to the support structure and arranged to press against the web, with which blade the excess coating mix approaching from the application zone can be removed.

a separate predoctoring blade, which is placed at a short distance before the actual doctor blade to press against the web in a similar manner for smoothing out disturbances in the coating mix flow before the mix proceeds up to the actual doctor blade, and the predoctoring blade and the actual doctor blade are attached to a clamp between parts and of the support structure by means of such an intermediary piece placed between the blades that determines the spacing between the blades and has gaps for removal of excess coating mix entering between the blades.

2. A short-dwell coater in accordance with claim 1, wherein the intermediary piece has a comb-like cross section, whereby the gaps are formed by the spaces remaining between the fingers of the comb and either of the adjoining blades.

3. A short-dwell coater in accordance with claim 1, wherein the intermediary piece has an essentially constant thickness, whereby the planes of the blades are aligned essentially parallel.

4. A short-dwell coater in accordance with claim 1, wherein the intermediary piece has an increasing thickness toward the tips of the blades, whereby also the spacing of the blades increases toward the tips.

* * * * *